US007926544B2

(12) United States Patent
Greif et al.

(10) Patent No.: US 7,926,544 B2
(45) Date of Patent: Apr. 19, 2011

(54) CASTING METHOD AND CASTING PLANT FOR CARRYING OUT THE METHOD

(75) Inventors: Andreas Greif, Weilheim (DE); Thomas Speidel, Markgröningen (DE)

(73) Assignee: ads-tec GmbH, Leinfelden-Echterdingen (DE)

( * ) Notice: Subject to any disclaimer, the term of this patent is extended or adjusted under 35 U.S.C. 154(b) by 333 days.

(21) Appl. No.: 12/096,376

(22) PCT Filed: Jul. 8, 2006

(86) PCT No.: PCT/EP2006/006712

§ 371 (c)(1), (2), (4) Date: Jun. 6, 2008

(87) PCT Pub. No.: WO2007/065489

PCT Pub. Date: Jun. 14, 2007

(65) Prior Publication Data

US 2008/0289790 A1 Nov. 27, 2008

(30) Foreign Application Priority Data

Dec. 7, 2005 (DE) ..... 10 2005 058 638
Dec. 20, 2005 (DE) ..... 10 2005 060 826

(51) Int. Cl.
*B22D 35/04* (2006.01)

(52) U.S. Cl. ..... 164/136; 164/336

(58) Field of Classification Search ..... 164/136, 164/336

See application file for complete search history.

(56) References Cited

U.S. PATENT DOCUMENTS

2002/0000304 A1 1/2002 Kahn et al.

FOREIGN PATENT DOCUMENTS

JP 2-220763 * 9/1990

* cited by examiner

*Primary Examiner* — Kuang Lin
(74) *Attorney, Agent, or Firm* — Gudrun E. Huckett

(57) ABSTRACT

In a casting method for producing a cast part, a melt to be cast is filed into a container and the mold is connected seal-tightly to the container. The mold and the container are rotated together so that the melt flows from the container into the mold. The mold and the container are separated from another and the cast part is removed from the mold. The casting plant for performing the method has a mold that is pivotably supported about a first axis of rotation to perform a first movement that is a pivot movement in a first movement direction. A container is pivotably supported about a second axis of rotation. The mold is supported so as to be movable by a second movement in a second movement direction.

18 Claims, 10 Drawing Sheets

CASTING METHOD AND CASTING PLANT FOR CARRYING OUT THE METHOD

BACKGROUND OF THE INVENTION

The invention concerns a casting method for producing a cast part by means of a mold. The invention further concerns a casting plant for carrying out the casting method.

It is known to fill a melt from a melt container into a mold for producing cast parts. In known casting methods and casting plants there are often comparatively long cycle times. The reason for the long cycle times is in part that the individual processing steps can be performed only at minimal speeds. For example, the speed with which the melt container can be moved is limited by the filling level of the container. At high filling level the container can be moved only slowly in order to prevent spilling of the melt. Long cycle times are also required when individual process steps must be carried out sequentially as a result of the configuration of the casting plants. A further disadvantage of known casting plants is the massive and large-size construction that makes it difficult or prevents installation in existing manufacturing buildings. In tight spaces, the large size of a casting plant impairs or prevents accessibility for maintenance and cleaning purposes. Difficult access causes an increased time demand for maintenance and cleaning; this leads to increased downtimes of the casting plant.

It is an object of the invention to provide a casting method with which short cycle times can be realized and which has a high process safety. A further object of the invention resides in that a casting plant is to be provided for performing the method.

SUMMARY OF THE INVENTION

This object is solved with regard to the method by a casting method according to which the melt to be cast is filled into a container; the container is connected seal-tightly to the mold; the mold and the container are rotated together so that the melt flows from the container into the mold; the mold and the container are separated from another; and the cast part is removed from the mold. With respect to the casting plant the object is solved by a casting plant comprising a mold that is pivotably supported about a first axis of rotation, and comprising a container that is pivotably supported about a second axis of rotation, wherein the mold is supported so as to be movable in a second movement direction in addition to being pivotable about the first axis of rotation.

It is provided that for producing a casting part by means of a mold, the mold is to be connected fixedly to a container that contains melt and subsequently the mold is rotated together with the container about a common axis of rotation so that the melt flows into the mold. The mold in this method is supported rotatably about an axis of rotation about which also the common rotational movement is performed. In that the mold and the container for introducing the melt into the container are rotated together, cast parts of high quality can be obtained. The quantity of the melt that is not required for producing the cast part but for risers and the like, can be minimized so that the quantity of metal that must be melted again and returned into the material circulation is minimal. The method can be performed at high cycle times.

In known methods, the melt is transported in the container to the mold. Because the mold weighs several metric tons, e.g. for casting engine blocks or cylinder heads of motor vehicles, the movement of the comparatively lightweight container for the melt can be performed easily. The liquid melt in the container is of very low viscosity. In order to prevent spilling of the melt or wetting of the sealing rim, the container must therefore be comparatively tall. When the sealing rim is wetted with melt, a seal-tight connection between the mold and the container can no longer be ensured. Wetting of the sealing rim is therefore to be avoided at all costs. When increasing the cycle time, the risk of spilling of the melt in the container and thus the risk of wetting the sealing rim increase.

The casting method according to the invention provides that the mold is moved into a position above the container after the melt to be cast has been filled into the container. Moving the container with the melt contained therein can thus be avoided. Despite its high weight of several metric tons, the mold can be moved very quickly to the position above the container so that high cycle times can be realized. In that the container is not moved or moved only minimally, it is possible to fill the container to a level immediately below the rim so that short risers in the mold can be realized. In this way, a high yield of the cast material is obtained so that only a minimal amount of material is returned into circulation to be melted again.

Advantageously, the container is not moved when the mold is moved into position above the container. It is provided that the mold is moved in a combined translatory and rotary movement into the position above the container. The combined translatory and rotary movement can be realized in a simple way by means of a single drive so that the method can be performed in a casting plant having only one drive for the mold. The combined translatory and rotary movement enables movement of the mold onto the container with a movement component that is perpendicular to the plane between container and mold.

It is provided that the mold and the container are rotated together about at least 180°. In this way, emptying of the container as much as possible into the mold is ensured. At the same time, an advantageous filling of the mold is achieved. Expediently, the mold and the container are rotated together about a horizontal axis of rotation. Advantageously, the mold and the container perform a translatory movement while being rotated together. However, it can also be provided that container and mold together perform simply a rotary movement and that after common rotation the container and the mold are separated. Subsequently, the mold can perform a translatory movement.

It is provided that before effecting the seal-tight connection of the container and the mold and in particular before movement of the mold into a position above the container at least one core is inserted into the mold. The insertion of at least one core can be done from above, for example, by means of a portal. In this way, the casting method can be automated easily. Advantageously, the placement of the core is done during filling of the melt to be cast into the container. Because both method steps are carried out simultaneously and not sequentially, the cycle time for producing the cast part can be further reduced. Expediently, the container is secured on at least one arm so as to be movable in at least one movement direction. In particular, the container is decoupled before common rotation of container and mold from the at least one arm and after common rotation is coupled to the at least one arm. As a result of the movement of the container independent of the movement of the mold, the container can be pivoted away from the mold so that excellent accessibility of the mold is provided. In that the arm is decoupled from the container before the mold and the container are rotated together, the common rotation can be performed without impairments. It is therefore not necessary to provide additional degrees of freedom for the arm. Advantageously, the container is secured on the arm so as to be pivotable about an axis of rotation. The container can also be secured on several, in particular, two arms. However, it can also be provided that the container is secured on one side on an arm and that the container is supported on the opposite side in the filled state. The support is realized in particular on the frame of the casting plant.

The casting plant with which the casting method can be performed has a mold that is pivotably supported on a first axis of rotation as well as a container that is pivotable about a second axis of rotation. The mold is movably supported in a second movement direction in addition to being pivotable about the first axis of rotation.

Because of the movable support of the mold in a second movement direction it is enabled that the mold can be moved into a position above the container. The second movement direction can be a pivot movement about a second axis of rotation or a translatory movement. The second movement direction enables the mold to be moved into the position above the filled container while the container remains stationary. In this way, spilling of the liquid melt in the container is prevented. The second movement direction of the mold enables in particular also that during insertion of at least one core into the mold the container can be filled with the melt.

The second movement direction is advantageously a longitudinal direction. In this way, the mold can perform a translatory movement in addition to the rotary movement. In particular, the longitudinal direction is positioned at a slant to a horizontal. Because of the slant of the longitudinal direction, the mold can be placed from above onto the container. Advantageously, the rotary movement of the mold is coupled to the movement in the longitudinal direction. In this way it is possible to move the mold with only one drive in the longitudinal direction and about the axis of rotation so that a simple configuration of the casting plant for performing the casting method is provided.

However, it can also be provided that the second movement direction is a pivot movement about a second axis of rotation. A pivot movement can be realized constructively in a comparatively simple way. For an appropriate arrangement of the second axis of rotation, the pivot movement also enables a placement of the mold onto the container from above.

It is provided that the mold is driven by a planetary gear that is in particular the second stage of a multi-stage gear system. The drive of the mold by means of a planetary gear enables a very large transmission ratio so that a satisfactorily large drive moment for the movement of the mold can be generated. This is required because of the great weight of the mold of several metric tons. By using a planetary gear with several planet wheels it is possible to design the bearing of the mold in a very safe way. This can be achieved in that each planet wheel is designed such that it can move the weight of the mold by itself. In this way, the safety factor is multiplied by the number of planet wheels.

A large transmission ratio is achieved when the mold is fixedly connected to the outer ring of the planetary gear. Coupling of the translatory and rotary movements can be achieved in that a wheel, especially a toothed wheel, that is fixedly connected to the moved outer ring of the planetary gear, rolls on a stationary toothed rack extending in the longitudinal direction. A rotation of the outer ring of the planetary gear effects thus a pivot movement of the mold about the axis of rotation of the outer ring of the planetary gear as well as rolling of the outer ring of the planetary gear on the toothed rack and thus a movement of the mold in the longitudinal direction. By means of an appropriate configuration of the size of the wheel, the movement of the mold in the longitudinal direction can be matched to the rotary movement. Advantageously, the first axis of rotation of the mold as well as the second axis of rotation of the container extend horizontally.

In order to enable excellent sealing between the container and the mold, it is provided that the mold and/or the container have means for tolerance compensation between the sealing surfaces of the mold and the container that rest against one another during common rotation. In this way, it can be ensured that the mold and the container will rests against one another seal-tightly during common rotation.

It is provided that the mold has a holder with a closed frame on which the mold is secured. The frame is in particular of a monolithic configuration. By providing the frame as a closed frame, a high stability of the construction is provided at minimal weight and minimal demand for space. The mold has a mold cavity. Advantageously, the closed frame extends in a plane that is parallel to the first axis of rotation of the mold and that intersects the mold cavity. The mold comprises the actual chill mold that is made from metal and that has a great weight. On this chill mold the actuating devices, for example, slides and the like, are arranged whose weight is significantly smaller than that of the chill mold. The center of gravity of the mold is therefore usually at the level of the mold cavity. In order to provide a beneficial force flow, the frame is positioned as close as possible to the center of gravity so that short travel and thus a short lever arm are provided. In this way, the construction can be designed with minimal weight and high stability.

It is provided that the mold has a fill opening where the container can be secured by means of at least one clamping element. Advantageously, at least one actuator for a clamping element is arranged on the bottom side of the mold facing away from the fill opening. In the area of the fill opening, the thermal load is very high while at the bottom side of the mold reduced temperatures are present. By positioning the actuators on the bottom side, they can be arranged in an area that is thermally less loaded. In this way, the durability of the actuators is increased.

The construction of the mold with a frame and the actuation of the clamping elements concern an independent inventive concept that can be used also in a casting plant in which the mold and the container are not rotated about a common axis.

Advantageously, the mold has at least one movably supported cover element wherein the movement of at least one clamping element is coupled to the movement of the at least one cover element. A cover element can be e.g. a flap or a slide that secures one or several cores in the mold so that upon rotation of the mold slipping or dropping of the cores is prevented. By coupling the movement of the clamping element to the movement of the at least one cover element, the cover element and the clamping element can be pivoted simultaneously out of the area of the fill opening of the mold so that the mold cavity for insertion of the cores or removal of the cast part is freely accessible. After insertion of the cores by means of a coupled movement, the cover element is arranged at the fill opening and the clamping element is pivoted into the area of the fill opening so that for achieving the final fixation of the container only a minimal adjusting movement is required. Advantageously, the actuation of the cover element and the movement of at least one clamping element is realized by one or several pivotably supported arms that are connected to one another. In particular, two actuators for each cover element are provided that are arranged on arms that are connected to one another and are actuatable by means of a common arm. A clamping element is advantageously arranged on a connecting web of the two arms between the two actuators of a cover element. In this way, pressing the container against the mold and closing of the cover element or cover elements are realized by a combined linkage that can have one or several actuations. In particular, a common actuator is provided for moving the cover element and for inward and outward pivoting of the clamping element and at least one further actuating element is provided for the final pressing movement of the container.

BRIEF DESCRIPTION OF THE DRAWINGS

Embodiments of the invention will be explained in the following with the aid of the drawing. It is shown in.

DESCRIPTION OF PREFERRED EMBODIMENTS

In FIGS. 1 to 8 the course of a casting method is schematically illustrated. For performing the method, a mold 1 is provided for casting a cast part as well as a container 2 for receiving the liquid metal melt, for example, liquid aluminum. The container 2 is in particular a tundish. The mold 1 and the container 2 are schematically shown in a side view. The container 2 is a trough. In the cleaning position of the mold 1 and the container 2 illustrated in FIG. 1, the mold 1 and the container 2 are accessible in the direction of the arrow 6 so that the mold 1 and the container 2 can be cleaned by an operator.

Figure 2:
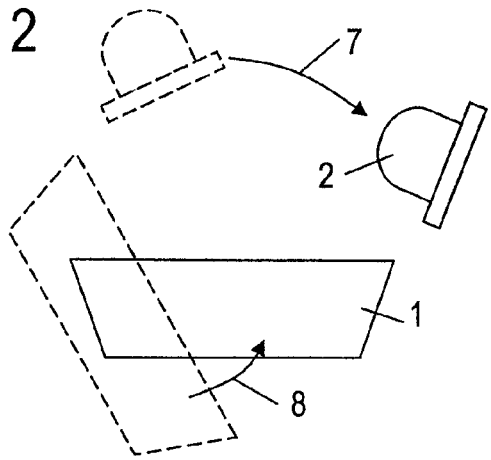

As shown in FIG. 2, after the cleaning step the mold 1 and the container 2 are moved into a position for core insertion. In this connection, the container 2 is pivoted in the direction of arrow 7 so that the container 2 is arranged above and laterally relative to the mold 1 so that the mold 1 is accessible from the top. The mold 1 is pivoted in the direction of arrow 8 into a horizontal position.

Figure 3:
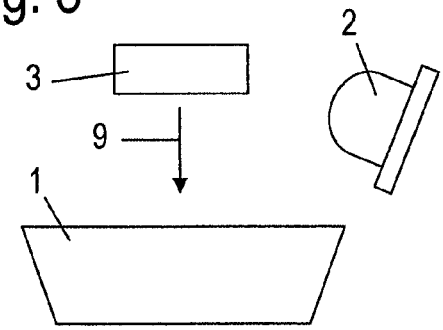

As shown in FIG. 3, after the mold 1 and the container 2 have been pivoted into the core insertion position, a core 3 is inserted in the direction of arrow 9 from above into the mold 1. In this method step, any number of cores can be inserted into the mold 1. Advantageously, the insertion of the cores 3 is done in a fully automated way. The cores 3 are advantageously inserted by grippers into the mold 1. The grippers are arranged in particular on a portal that extends across the mold 1.

Figure 4:
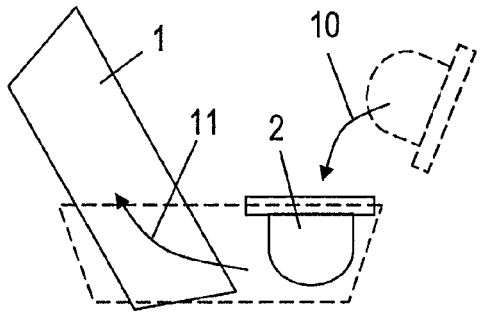

In the next method step illustrated in FIG. 4, the mold 1 and the container 2 are pivoted into the filling position. The container 2 is pivoted in the direction of arrow 10 and the mold 1 in the direction of arrow 11. The position of the mold 1 in the filling position corresponds advantageously approximately to the position of the mold 1 in the cleaning position. The mold 1 is positioned at a slant in the filling position and adjacent to the container 2. The container 2 in the filling position is lower than in the cleaning position and in the core insertion position.

Figure 5:
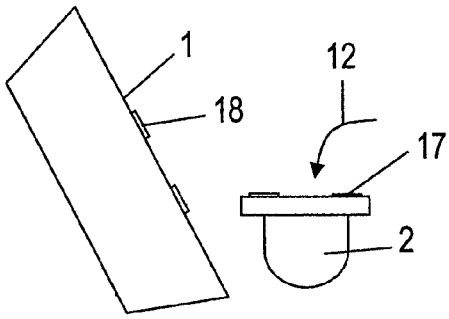

In the subsequent method step illustrated in FIG. 5, the melt, as indicated by the arrow 12, is filled into the container 2. In FIG. 5, the sealing surfaces 17 of the container 2 and the sealing surfaces 18 of the mold 1 are shown enlarged and schematically. When filling the container 2 with melt, the sealing surface 17 on the container 2 must not be wetted because this would prevent seal-tight closure of mold 1 and container 2. The movement for filling in the melt is advantageously coupled with a movement of the container 2 in the downward direction. When filling in the melt, the container 2 carries out a movement in the downward direction.

Figure 19:
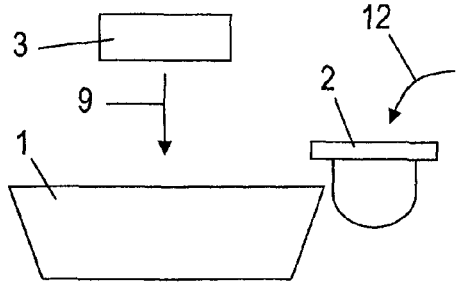
FIG. 19 a schematic illustration of a method step of the casting method.

The insertion of one or several cores 3 can also be carried out simultaneously with the step of filling the melt to be cast into the container 2. This is illustrated schematically in FIG. 19. In order to be able to insert a core 3 while the melt is being filled into the container 2, the container 2 is pivoted from the cleaning position illustrated in FIG. 1 directly into a position in which the container 2 faces with its fill opening upwardly. As shown in FIG. 19, the container 2 is arranged adjacent to the mold 1 so that the mold 1 is accessible from above. In this way, simultaneously the core 3 can be inserted in the direction of arrow 9 into the mold 1 and the melt to be cast, as indicated by the arrow 12, can be filled into the tub-shaped container 2. Since both method steps are performed simultaneously, the cycle time for producing a cast part is further reduced in this way.

Figure 6:
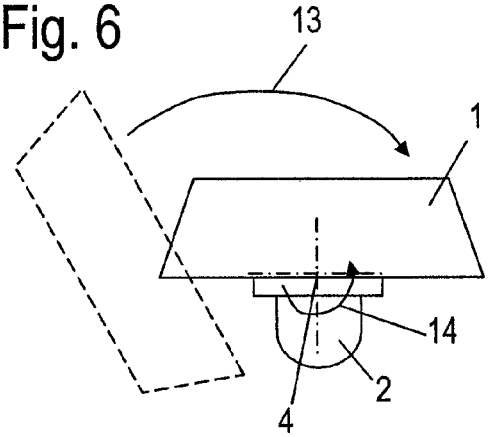

As shown in FIG. 6, the mold 1 is pivoted in the next method step along arrow 13 into a position above the container 2. When doing so, the mold 1 performs a rotary and a translatory movements. The mold 1 is positioned such above the container 2 that the sealing surfaces 17 and 18 rest seal-tightly against one another and the mold 1 with its open side faces downwardly and rests on the container 2 that is open in the upward direction. When pivoting the mold 1 into the position above the container 2, the container 2 is not moved so that spilling of the liquid melt from the container 2 or wetting of the sealing surface 17 of the container 2 is prevented.

Subsequently, the container 2 is secured on the mold 1. After the container 2 has been secured fixedly and seal-tightly on the mold 1, the mold 1 and the container 2 can be rotated in the direction of arrow 14 about a common axis of rotation 4. The rotation is carried out in a direction opposite to the movements shown by arrows 11 and 13 so that the mold 1 as a whole must be movable only by 180°.

Figure 7:
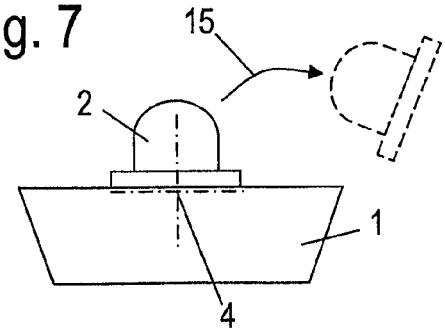
Figure 8:
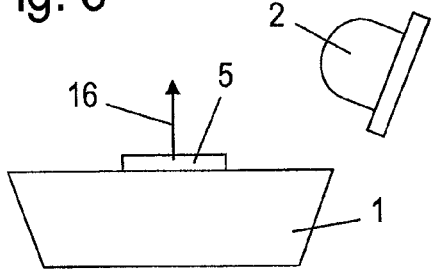

In FIG. 7, the mold 1 and the container 2 are shown after rotation about axis of rotation 4 by 180°. After common rotation the container 2 is moved away from the mold 1 in the direction of arrow 15. As shown in FIG. 8, in the subsequent last method step the cast part 5 is removed in the direction of arrow 16 from the mold 1. The container 2 in this position is above and adjacent to the mold 1 in a position that corresponds approximately to the core insertion position. In this way, unhindered access of the cast part 5 from above is possible.

Figure 1:
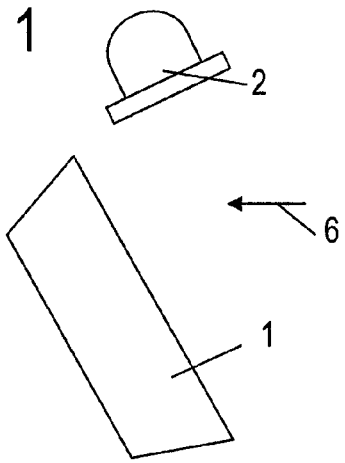
FIGS. 1 to 8 schematic illustrations of the course of the casting method.

After removal of the cast part 5, the mold 1 and the container 2 move again into the cleaning position illustrated in FIG. 1 and the manufacture of the next cast part 5 begins.

Figure 9:
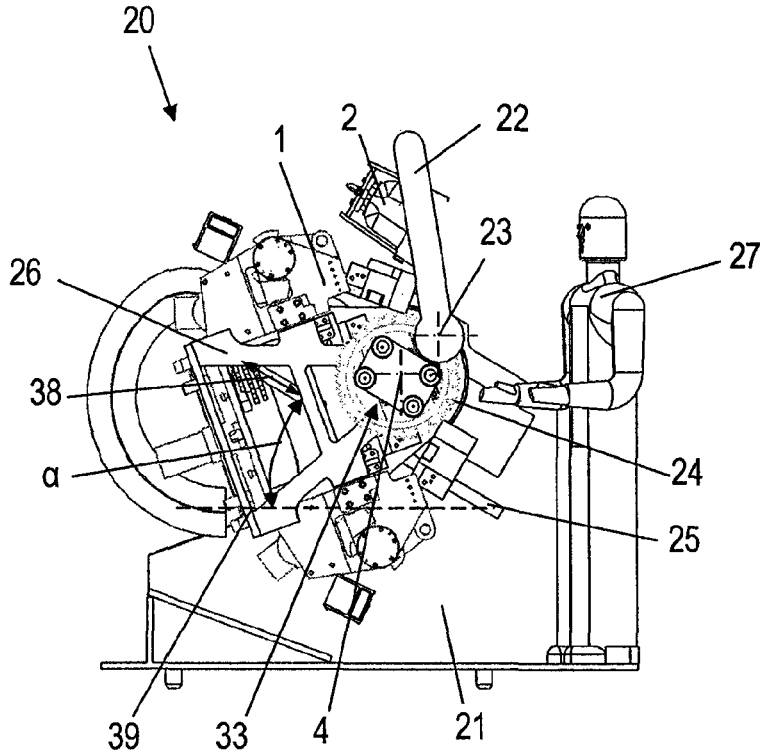
FIG. 9 a side view of a casting plant during the cleaning process.

In FIGS. 9 to 18 a casting plant 20 for performing the casting method according to FIGS. 1 to 8 is illustrated. In FIG. 9 the casting plant 20 is in the cleaning position. The mold 1 and the container 2 are slanted relative to the horizontal 39 so that the interior of the mold 1 as well as the interior of the container 2 are accessible for an operator 27. The container 2 is trough-shaped. The mold 1 is supported on opposite sides by a holder 26 on a frame 21. FIG. 9 shows only the sidewall of the frame 21 positioned behind the mold 1. The support of the holder 26 on the frame 21 is realized at least on one side of the mold 1 by a planetary gear 33.

The mold 1 is rotatably supported about axis of rotation 4 of the outer ring (not illustrated) of the planetary gear 33. The outer ring of the planetary gear 33 is a moved ring and is driven in rotation by the planetary gear 33 about axis of rotation 4. A toothed wheel 24 is secured on the outer ring of the planetary gear 33. The toothed wheel 24 can be configured as a monolithic part of the outer ring of the planetary gear 33. The toothed wheel 24 is fixedly secured on the holder 26 of the mold 1. The toothed wheel 24 rolls on the toothed rack 25. Instead of the toothed rack 25 it is also possible to provide a linear guide for the toothed wheel 24 on which the toothed wheel 24, or a wheel provided in place of the toothed wheel 24, can roll. The toothed rack 25 is secured to the frame 21 of the casting plant 20. The toothed rack 25 is positioned relative to the horizontal 39 at an angle $\alpha$ that tapers toward the operator 27 and that is, for example, approximately 30°. The toothed rack 25 defines a longitudinal direction 38 in which direction the mold 1 can be moved.

The container 2 of the casting plant 20 is secured by arm 22 on the frame 21 so as to be pivotable about axis of rotation 23. The arm 22 is pivotably supported on the frame 21 of the casting plant 20. Instead of the arm 22, the container 2 can be supported on several arms, in particular two arms 22. Advantageously, the container 2 is supported at opposed sides.

Figure 10:
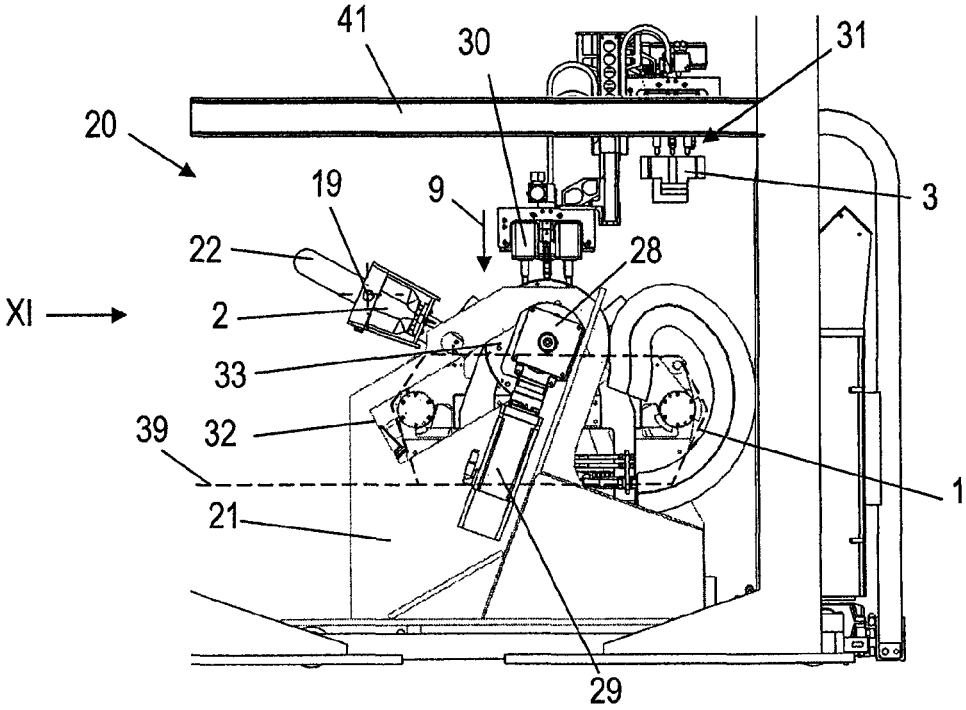
FIG. 10 a side view of the casting plant during insertion of a core from a side of the casting plant opposite the side illustrated in FIG. 9.
Figure 11:
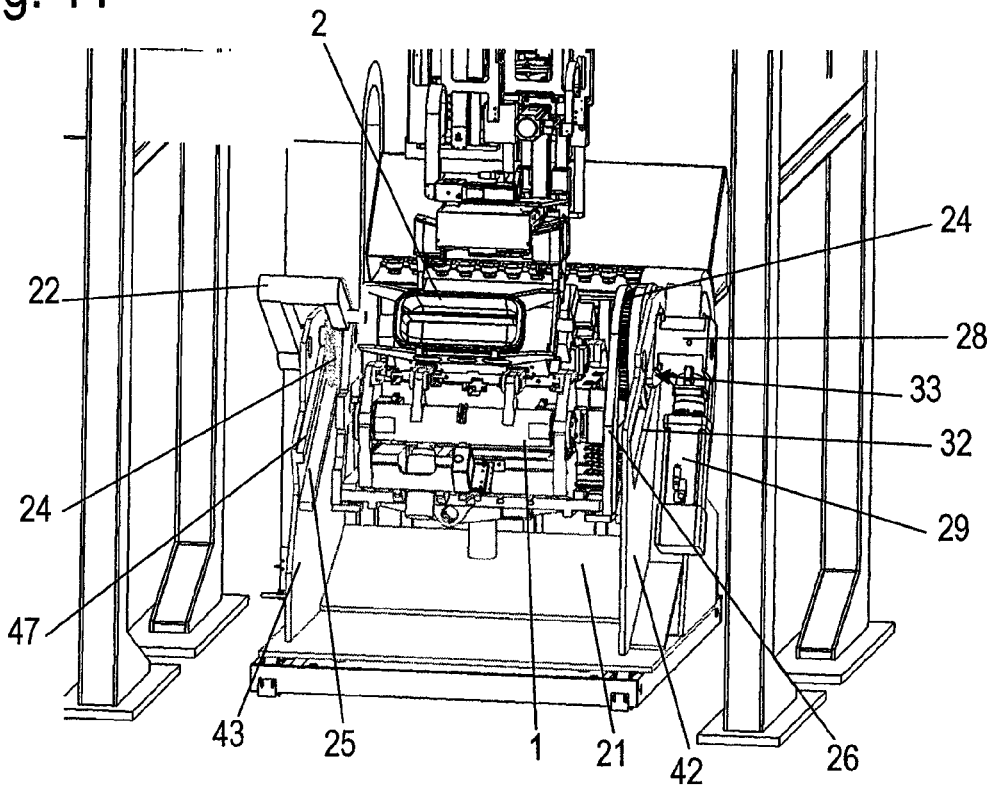
FIG. 11 a side view of the casting plant in the direction of arrow XI in FIG. 10.

After cleaning the mold 1 and the container 2, the mold 1 and the container 2 move into the core insertion position illustrated in FIGS. 10 and 11. For this purpose, the arm 22 is pivoted about axis of rotation 23 toward the operator 22, i.e., in clockwise direction in FIG. 9. Upon pivoting the arm 22, the container 2 performs a rotary movement about axis of rotation 19 relative to the arm 22. The relative movement of the container 2 relative to the arm 22 is advantageously coupled to the movement of the arm 22. This coupling action can be realized for example by chains that are connected to the arm 22. In this connection, the chains connect a fixedly mounted chain wheel on the axis of rotation 23 of the arm 22 with a chain wheel that is movably arranged about axis of rotation 19 of the container 2 and fixedly attached to the container 2. The number of teeth of the two chain wheels are advantageously different so that the rotary speed of the arm 22 about axis of rotation 23 differs from the rotary speed of the container 2 about axis of rotation 19.

Coupling of the rotary movement of the container 2 about the axis of rotation 19 to the rotary movement of the arm 22 about the axis of rotation 23 can also be achieved by a bevel gear fixedly mounted at the axis of rotation 23 and interacting by means of a shaft arranged in the arm 22 with a further bevel gear that is arranged at the axis of rotation 19. By coupling the movement of the container 2 to the movement of the arm 22 only one drive for the container 2 and the arm 22 is required. Advantageously, the drive for the arm 22 is arranged in the area of the axis of rotation 23 between the arm 22 and a sidewall 43 of the frame 21 illustrated in FIG. 11. In this way, the drive can be arranged stationarily on the frame 21 and must not move together with the arm 22. Instead of an arm 22 it is also possible to provide two arms 22. In this connection, it is advantageous to provide one arm 22 on one sidewall 42 of the frame 21 and the other arm 22 on the oppositely positioned sidewall 43 of the frame 21.

For moving into the core insertion position, the mold 1 is pivoted into a horizontal position indicated by horizontal 39. For this purpose, the toothed wheel 24 in the illustration of FIG. 9 is driven counterclockwise. In this way, the mold 1 performs a movement in a counterclockwise direction about axis of rotation 4 as well as a translatory movement in an upward direction along the toothed rack 21 that is slanted relative to the horizontal 39. The mold 1 moves away from the operator 27 and upwardly.

In FIG. 10, the position of the mold 1 in the core insertion position is illustrated in dashed lines. The casting plant 20 has a portal 41 where grippers 30 and 31 are supported so as to be movable.

The gripper 30 as well as the gripper 31 each insert a core 3 in the direction of arrow 9 into the mold 1. In the position illustrated in FIGS. 10 and 11, the gripper 30 inserts a core 3 into the mold 1. The gripper 31 is in a position laterally above the mold 1 and, after insertion of core 3 by the gripper 30, moves into the position above the mold 1 in order to insert a second core 3 into the mold 1. The container 2 has been moved by arm 22 out of the area of the mold 1 so that the mold 1 is freely accessible from above. As shown in FIGS. 10 and 11, the frame 21 has two sidewalls 42 and 43 on which the mold 1 is supported. The container 2 is supported with one side on the sidewall 43. However, it is also possible to provide a supporting action on opposed sides. The drive of the mold 1 is arranged on the opposite sidewall 42. The sidewall 42 has a guide 32 that is embodied as a slot in the sidewall 42 and that extends above the toothed rack 25 and parallel to the toothed rack 25. The guide 32 on the sidewall 42 forms a fixed bearing for the mold 1. On the opposite side, i.e., the sidewall 42, a guide 47 and a toothed rack 25 extending parallel thereto are provided that provide a floating bearing for the mold 1 and can compensate horizontal thermal expansion.

On the exterior side of the sidewall 42 facing away from the mold 1 a cranked arm 29 is provided that is pivotably supported. Neighboring the guide 32 there is a gear 28 arranged on the arm 29; this gear forms a first gear stage for driving the mold 1. In the gear 28 several gear stages can be realized. Through the guide 32 embodied as a slot, a drive shaft, not illustrated in FIG. 11, projects from the gear 28 and forms the drive pinion for the planetary gear 33. When moving the toothed wheel 24 along the toothed rack 25, the gear 28 is moved along the guide 32 on the arm 29.

Figure 12:
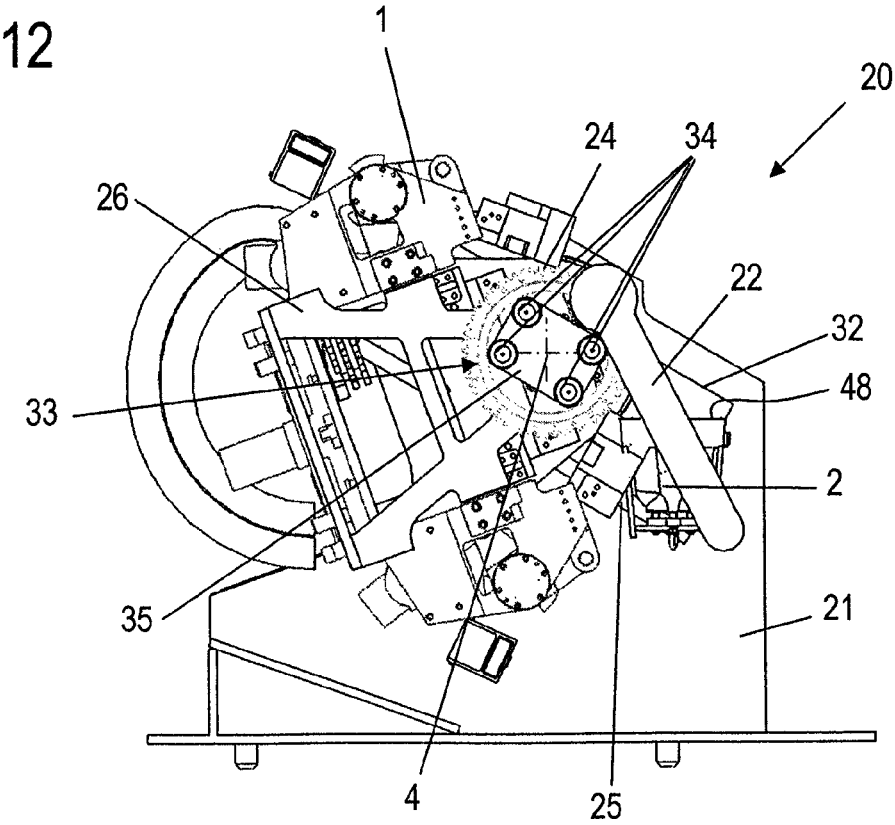
FIG. 12 a side view of the casting plant in the viewing direction corresponding to that of the illustration of FIG. 9 during filling of the container.

After insertion of the core 3, the mold 1 and container 2 move into the filling position illustrated in FIG. 12. For this purpose, the toothed wheel 24 is driven in clockwise direction in the illustration of FIG. 12. Accordingly, the toothed wheel 24 moves toward the side facing the operator 27 and downwardly. The mold 1 is pivoted from the position illustrated in FIG. 10 and FIG. 11 in the clockwise direction in the illustration of FIG. 12. In the filling position, the mold 1 is in a position that corresponds to the cleaning position shown in FIG. 9. As shown in FIG. 12, the planetary gear 33 has four planet wheels 34 that are driven by the gear 28 (FIG. 10). The four planet wheels 34 are connected to one another by a plate 35 and are stationarily connected to the gear 28 so that the planet wheels 34 cannot rotate about the drive pinion. In this way, the toothed wheel 24 that is connected to the moved outer ring of the planetary gear 33 is driven in rotation. The container 2 is in a pivot position that is pivoted relative to the cleaning position of FIG. 9 about approximately 180° about the axis of rotation 23. In this position the container 2 is arranged below the axis of rotation 4 of the mold 1 on a side of the mold 1 facing the operator. The fill opening 48 of the container 2 faces upwardly. In the filling position illustrated in FIG. 12 the container 2 is filled with liquid melt, in particular metal melt, such as aluminum melt. The container 2 can be filled completely or almost completely with liquid melt. During filling, the container 2 performs a movement in the downward direction that is coupled to the filling movement.

Filling of the container 2 can also be done during the insertion of a core 3 or several cores 3 into the mold 1. For this purpose, the mold 1 moves from the cleaning position into the core insertion position and the container 2 moves into the filling position. The filling position of the container 2 and the core insertion position of the mold 1 are to be selected such that the mold 1 as well as the container 2 are accessible.

Figure 13:
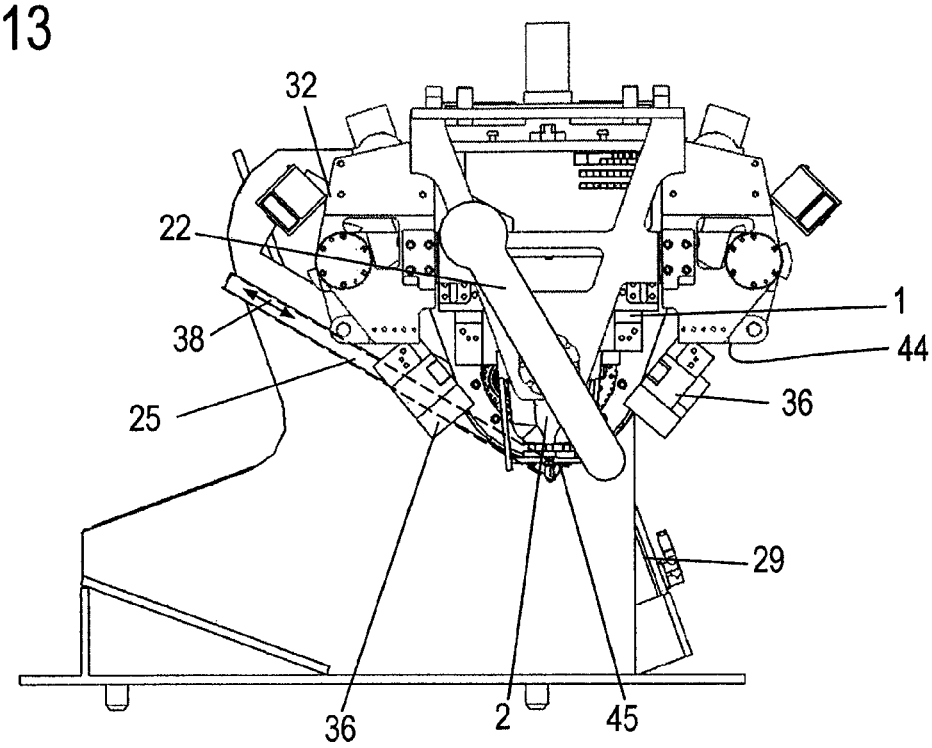
FIG. 13 the casting plant of FIG. 12 after pivoting of the mold into a position above the container.

After filling the container 2, the mold 1 as shown in FIG. 13 is pivoted into a position above the container 2. The container 2 does not change its position when the mold 1 is pivoted. When pivoting the mold 1, the toothed wheel 24 is driven in clockwise direction in the illustration of FIG. 12 so that the open filling side 44 of the mold 1 faces downwardly. The mold 1 is therefore rotated by 180° about the axis of rotation 4 relative to the core insertion position illustrated in FIG. 10. The toothed wheel 24 is located at the leading end 45 of the toothed rack 25 facing the operator. In that the mold 1 carries out a rotary movement about the axis of rotation 4 as well as a translatory movement in the longitudinal direction 38 that is parallel to the toothed rack 25, the mold 1 can be placed onto the container 2 with a directional component in the vertical direction, i.e., from above. The mold 1 has clamping elements 36 with which the container 2 can be tightly secured on the mold 1. As soon as the container 2 is secured by means of the clamping elements 36 of the mold 1, the arm 22 is decoupled from the container 2. The container 2 therefore can move independent of arm 22.

In order to compensate tolerances between the container 2 and the mold 1 and in order to achieve excellent seal-tightness between the mold 1 and the container 2, the mold 1 has a total of four clamping elements 36 that are configured as clamping claws. At each corner of the container a clamping element 36 is arranged. The clamping elements 36 pull the container 2 by a small travel in the range of a few millimeters against the mold 1 after the arm 22 has been decoupled from the container 2. The container 2 is pressed by the clamping elements 36 against the core or cores 3 in the mold 1. The clamping elements 36 are advantageously hydraulically actuated and valve-controlled so that the clamping elements 36 compensate tolerances and unevenness in the sealing surface between container 2 and mold 1 because each corner of the container 2 can move independently. By having the clamping elements 36 arranged on the mold 1, a short force flow results that does not extend through the axis of rotation 4 of the mold 1. In this way, the bearing of the mold 1 is loaded less. The means for tolerance compensation can also be arranged in the bearing of mold and/or container.

Figure 14:
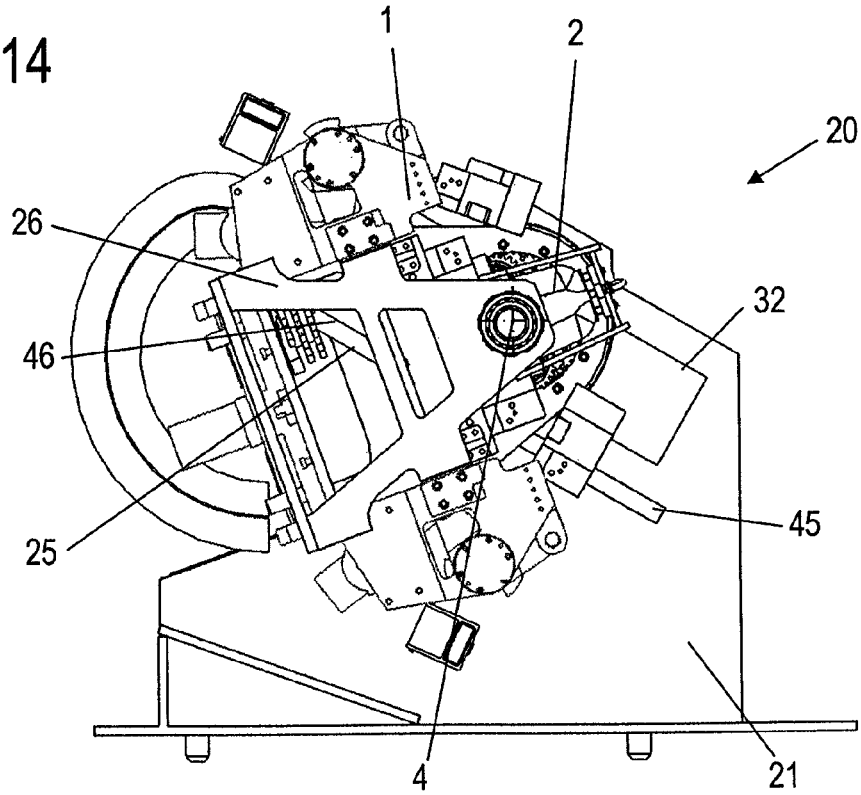
FIG. 14 a side view of the casting plant of FIG. 12 during common rotation of mold and container.
Figure 15:
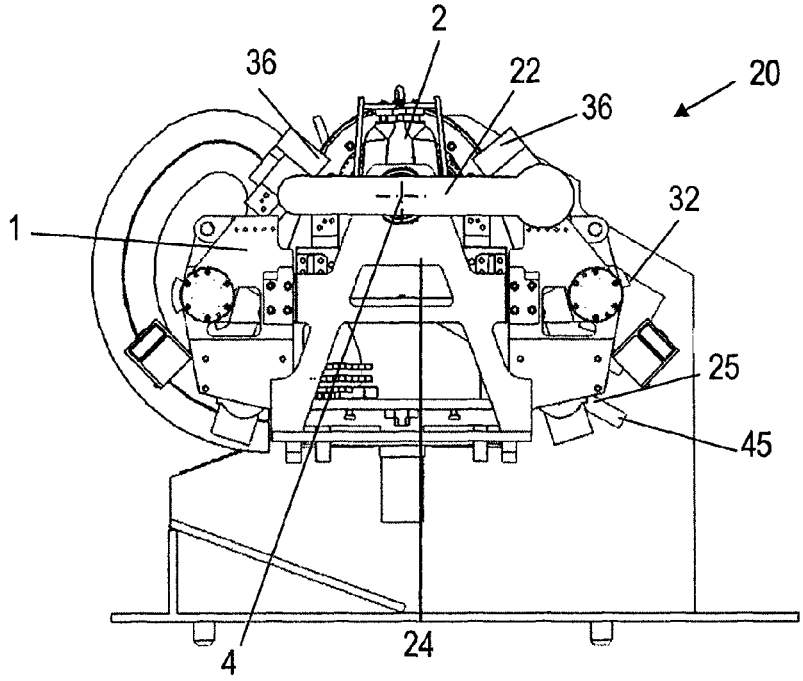
FIG. 15 a side view of the casting plant of FIG. 12 after common pivoting.

Subsequently, the mold 1 and the container 2 are rotated about 180° about the axis of rotation 4. This is illustrated in FIGS. 14 and 15. As shown in the Figures, the toothed wheel 24 rolls in counterclockwise direction from the front end 45 to the rearward end 46 of the toothed rack 25. The mold 1 thus rotates in a first rotational direction on the container 2 and in the opposite direction together with the container 2. In this way, the mold 1 must be rotatable only about a total of 180°.

FIG. 15 shows the casting plant 20 after common rotation of mold 1 and container 2 by 180° about the axis of rotation 4 of the mold 1. As a result of the rotation of container 2 together with the mold 1, liquid metal flows from the container 2 completely into the mold 1 and thus forms the cast part. After pivoting the clamping elements 36 are released. The arm 22 pivots from the position illustrated in FIG. 14 counterclockwise upwardly and toward the container 2. Subsequently, the container 2 is coupled to the arm 22. When performing coupling, the container 2 is automatically centered on the holder of the container 2 on the arm 22.

Figure 16:
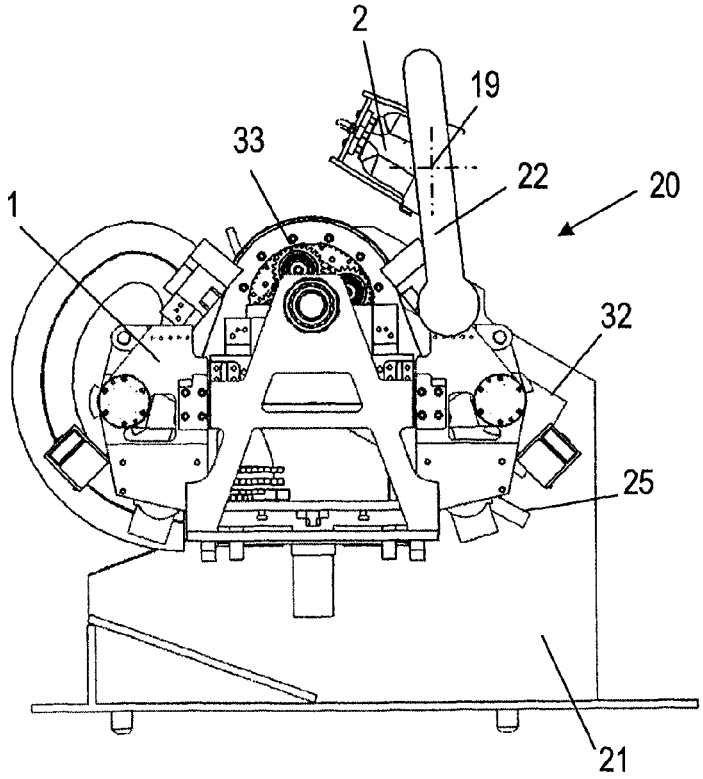
FIG. 16 a side view of the casting plant of FIG. 12 as the container is pivoted away.
Figure 17:
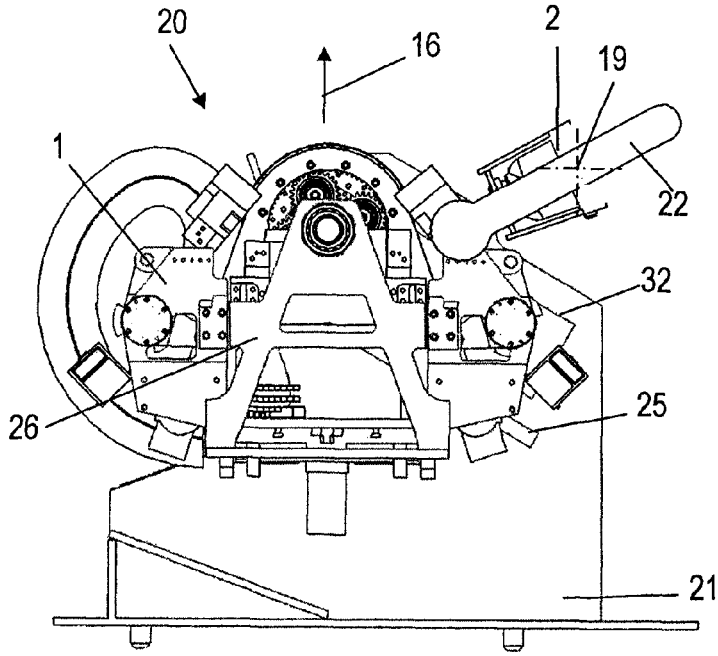
FIG. 17 a side view of the casting plant of FIG. 12 during removal of the cast part.

As shown in FIG. 16, the container 2 is subsequently lifted by the arm 22 from the mold 1 and pivoted away. The container 2 is pivoted into the core insertion position of the container 2 shown in FIG. 17 and, when doing so, performs a rotation in a counterclockwise direction in the Figures about the axis of rotation 19. In the position illustrated in FIG. 17 the container 2 is arranged above and laterally of the mold 1 so that the mold 1 is accessible from above and the cast part can be removed from the mold 1 in the direction of arrow 16. After removal, the mold 1 and the container 2 move into the cleaning position illustrated in FIG. 9 and the method is repeated.

Figure 18:
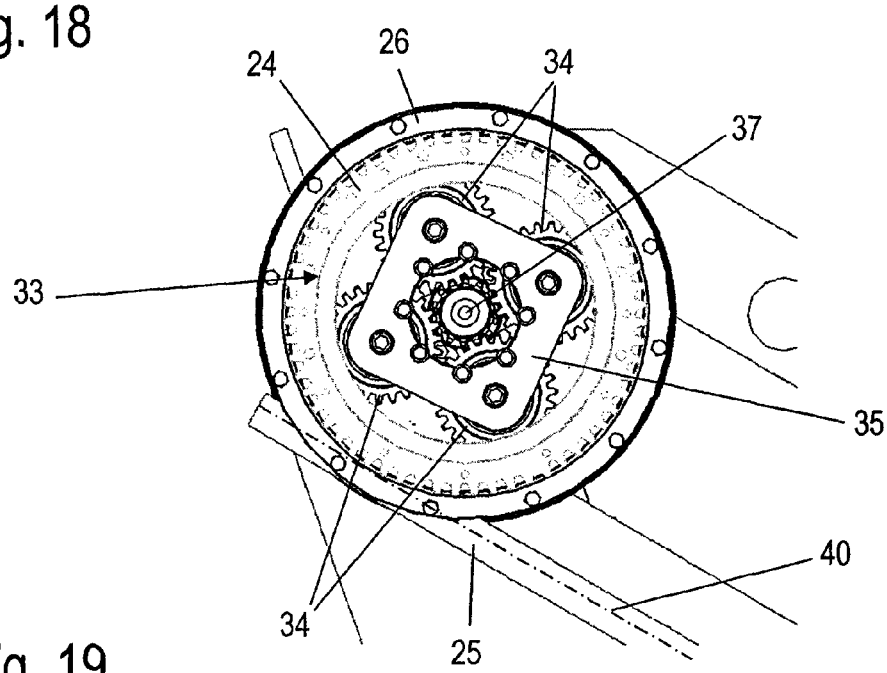
FIG. 18 a detail illustration of the planetary gear of FIG. 17.

In FIG. 18 the planetary gear 33 is shown in detail. The planetary gear 33 is driven by a pinion 37 that is the output shaft of gear 28. The pinion 37 drives four planet wheels 34 that are stationarily connected to the plate 35. The rotational movement of the planet wheels 34 effects a rotation of the outer ring of the planet gear 33 on which the toothed wheel 24 is secured. The outer ring of the planetary gear is supported on its outer circumference by means of a cross roller bearing in a housing part. The housing part is stationarily connected to the housing of gear 28. The toothed rack 25 on which the toothed wheel 24 rolls has a toothing 40 illustrated in FIG. 18 by a dash-dotted line. In the illustrated embodiment, four planet wheels 34 are provided. Each planet wheel 34 is designed such that it can support by itself the weight of the mold 1 of several metric tons. The four planet wheels 34 thus provide a quadrupling of the safety factor. If one of the planet wheels 34 fails, a safe supporting action of the mold 1 and a safe function of the cast plant 20 are still ensured.

Instead of the toothed rack 25 that interacts with the toothed wheel 24 and in this way effects coupled translatory and rotational movements, it is also possible to provide a linkage by means of which the mold 1 is moved in a correspondingly coupled movement.

In FIGS. 20 to 29 an embodiment of a casting plant 50 is illustrated. The casting plant 50 has a mold 51 supported on a frame 21. Same reference numerals as in FIGS. 1 to 19 indicate same components with the same function. The mold 51 is rotatably supported on two arms 59 about axis of rotation 4. The two arms 59 are arranged on opposed sides of the mold 51 and are connected by means of a shaft 60 to one another. The shaft 60 is arranged adjacent to bottom 63 of the frame 21 and extends between the two sidewalls 42 and 43 of the frame 21. On the shaft 60 the two arms 59 with the mold 51 are supported pivotably about a second axis of rotation 58 on the frame 21. For driving the mold 51 about the first axis of rotation 4 on the arm 59 positioned adjacent to the sidewall 43 a drive 61 with a gear 62 is provided and drives in rotation the mold 51 about axis of rotation 4.

Figure 21:
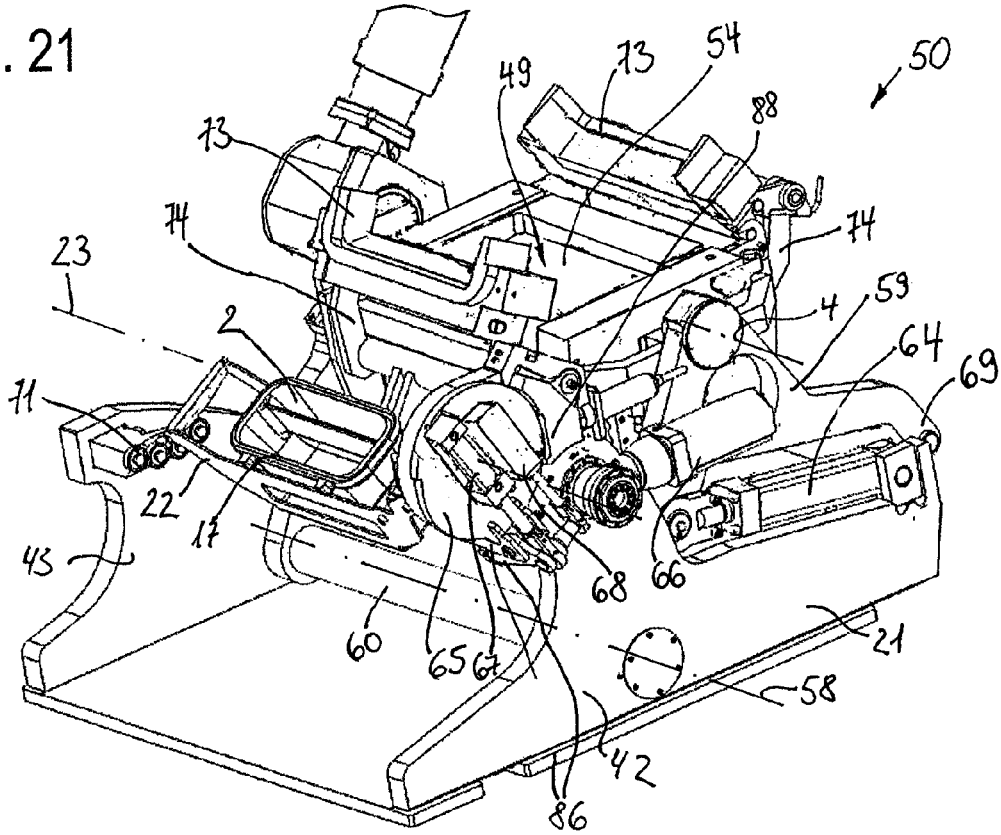
FIG. 21 the casting plant of FIG. 20 in a position for insertion of cores and for filling in the melt.

As shown also in FIG. 21, on the sidewall 42 opposite the sidewall 43 a plate 65 is supported rotatably about axis of rotation 23. Arm 22 is supported on plate 65 and container 2 is secured on the arm. The arm 22 is embodied as a receptacle in which the container 2 is positioned. On the bottom 87 of the arm 22 the container 2 is secured by means of several connecting bolts 72. The connecting bolts 72 secure the container 2 loosely on the bottom 87 so that the container 2 can move relative to the arm 22 by a predetermined amount. As shown in FIG. 21, the arm 22 is supported by levers 86 on the plate 65. A braking device 67 and a pivot drive 68 engage the levers 86. The pivot drive 68 moves the arm 22 relative to the plate 65 between the outwardly folded position shown in FIG. 22 and the position shown in FIG. 21 in which the arm is moved between the sidewalls 42 and 43. The braking device 67 represents a safety device. By means of the braking device 67 the arm 22 can be blocked. For moving the plate 65 with arm 22 and the container 2 about axis of rotation 23, the drive 66 is provided. On the circumference of the plate 65 a locking jaw 88 is arranged by means of which the plate 65 can be blocked.

Figure 20:
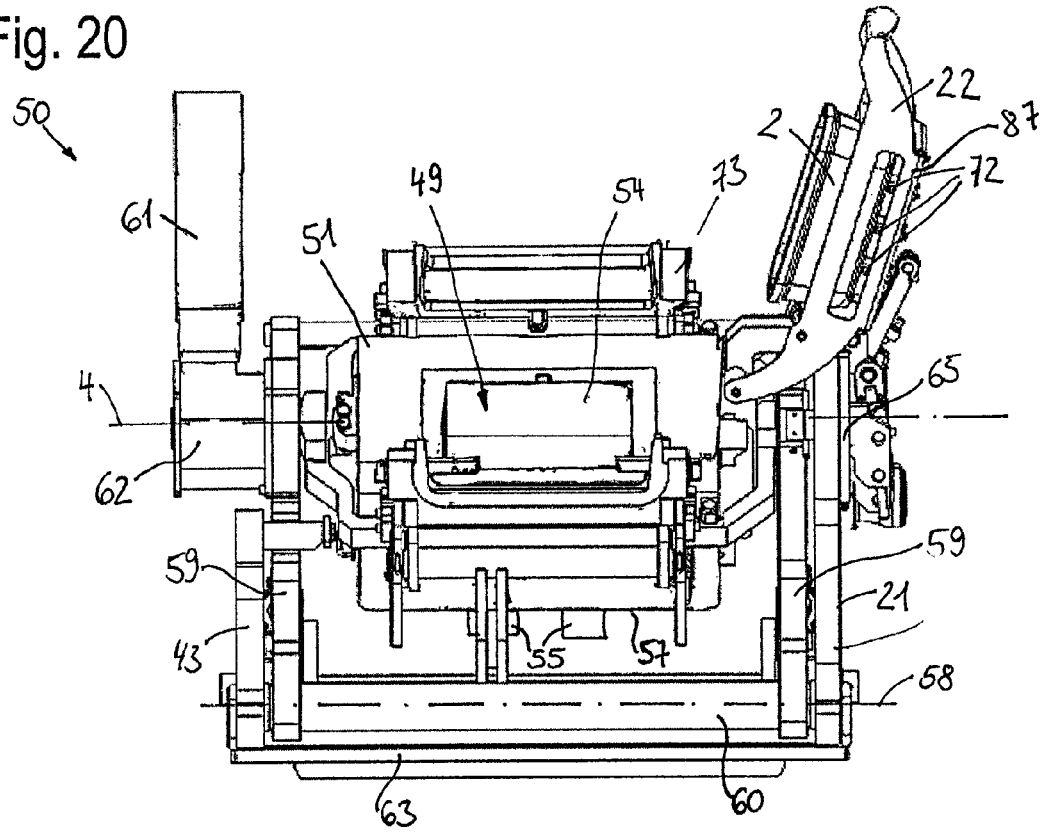
FIG. 20 a side view of a casting plant in a cleaning position.

As shown in FIGS. 20 and 21, the mold 51 has a mold cavity 49 that is accessible by a fill opening 54. Two flaps 73 are arranged on the mold 51 at the fill opening 54; the flaps can be pivoted about axes parallel to the axis of rotation 4 away from the fill opening 54 in the outward direction. The flaps 73 represent cover elements that secure the cores inserted into the mold 51 and that can cover the fill opening 48 at its rim area.

In FIG. 20 the casting plant 50 is shown in the cleaning position. The mold 51 is rotated about the first axis of rotation 4 such that the fill opening 54 points forwardly, i.e., toward an operator, and downwardly. The arm 22 with the container 2 is rotated outwardly toward the sidewalls 42 and upwardly about axis of rotation 23 (FIG. 21) and, in the position according to FIG. 20, at a slant forwardly, i.e. toward an operator. The mold cavity 49 of the mold 51 and the container 2 are accessible for an operator and can be cleaned in this position.

After cleaning the mold 51 and the container 2, the mold 51 moves into the core insertion position illustrated in FIG. 21. For this purpose, the mold 51 rotates about axis of rotation 4 until the fill opening 54 faces upwardly in a vertical direction. At the same time or with time delay the arm 22 is pivoted into the position between the sidewalls 42 and 43 and rotated about the axis of rotation 23 until the container reaches the filling position illustrated in FIG. 21. In this position, the end of the arm 22 facing the sidewall 43 is supported on supports 71 that are secured on the sidewalls 43. The supports 71 can be e.g. in the form of bearings. By means of the supports 71 the free end of the arm 22 is supported on the frame 21.

In the position of the casting plant 50 illustrated in FIG. 21, the cores are inserted into the mold 51, as has been explained in connection with FIGS. 10 and 11. At the same time, the container 2 is filled with melt. The sealing rim 17 of the container 2 must not be wetted with melt when doing so. In order to keep bubble formation in the melt at a minimal level, it is provided that the container 2 performs synchronously to the filling movement of a filling device, not illustrated, a pivot movement about axis 23. After the cores have been inserted into the mold cavity 49, the flaps 73 are closed. For realizing the opening and closing movements, the flaps 73 have actuating arms 74 that are actuated by means of actuators 55 schematically illustrated in FIG. 20; only one of them is shown partially in FIG. 21. The actuators 55 are arranged at the bottom side 47 of the mold 51 that is facing away from the fill opening 54. As shown in FIG. 21 the casting plant 50 has a drive cylinder 64 that is supported on the frame 21 and that pivots the arms 59 about axis of rotation 58. Both arms 59 have a cantilever 69 whose function will be explained in the following.

Figure 22:
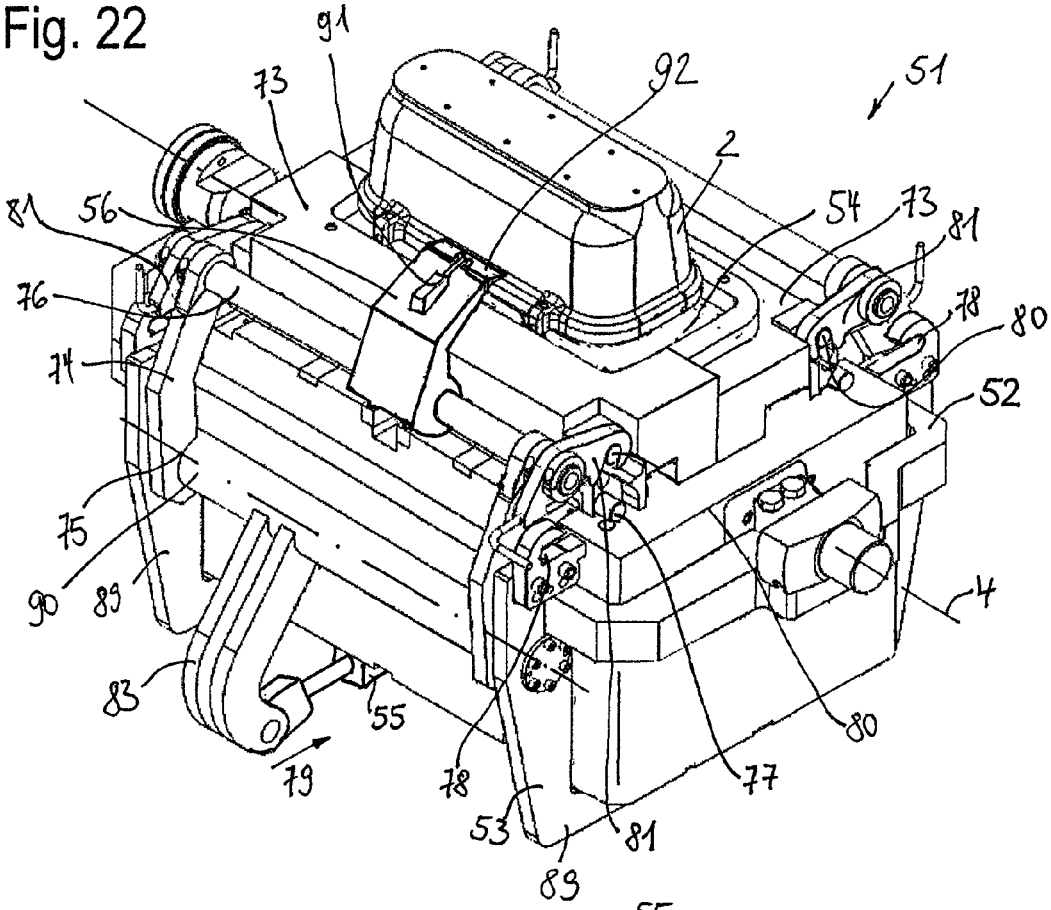
FIG. 22 the mold of the casting plant of FIG. 20 in a perspective illustration.
Figure 23:
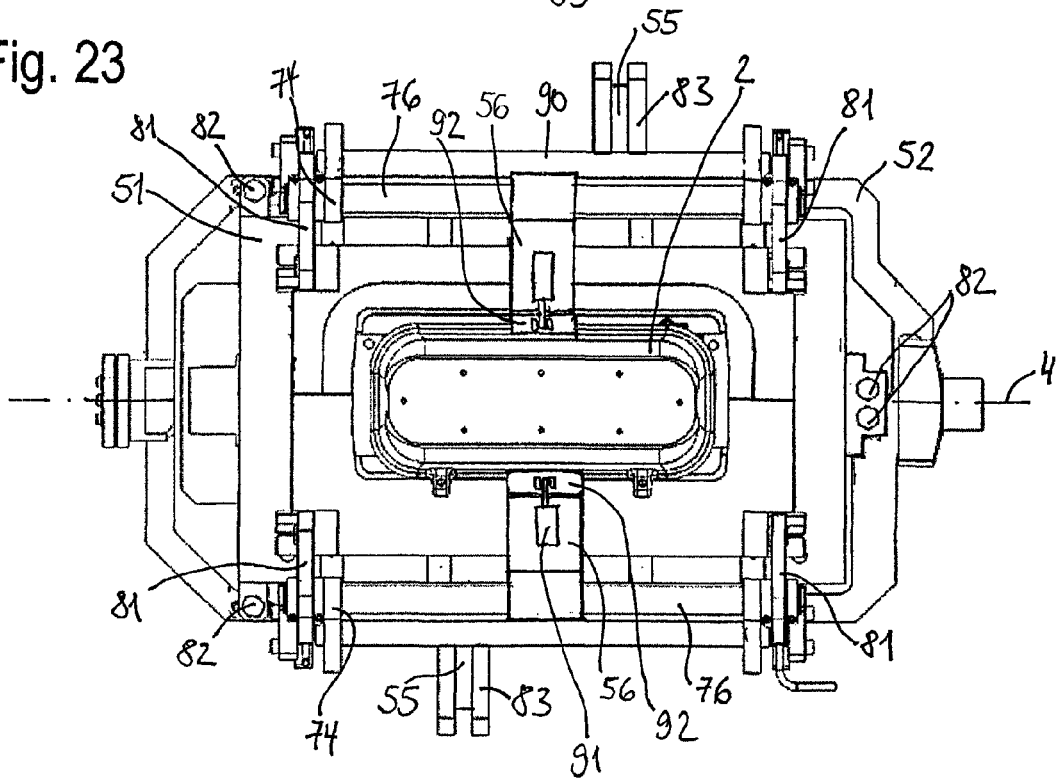
FIG. 23 a plan view onto the mold of FIG. 22.

In FIGS. 22 and 23, the mold 51 is shown together with the container 2 arranged thereat. As shown in FIG. 22, the mold 51 has a holder 53 that comprises two U-shaped receptacles 89 that are connected to one another by a closed monolithic frame 52. The legs of the U-shaped receptacles 89 extend at the terminal areas of the longitudinal sides of the mold 51 and face upwardly, i.e., toward the fill opening 54. In the two receptacles 89 the mold 51 is arranged. The frame 52 extends about the mold 51 along the circumference of the mold 51 in a plane that is parallel to the axis of rotation 4. The plane in which the frame 52 is arranged is positioned at a minimal spacing relative to the fill opening 54. Advantageously, the center of gravity of the mold 51 is located in the plane defined by the frame 52 or adjacent to said plane. The plane defined by the frame 52 intersects the mold cavity 49.

As shown in FIG. 23, the actual chill mold of the mold 51 is secured on the frame 52 by means of four fastening screws 82. Two of the fastening screws 82 are arranged above and adjacent to the axis of rotation 4. Instead of the two fastening screws 82 it is also possible to provide a single fastening screw 82. The two further fastening screws 82 are arranged at corner points of the chill mold and the frame 52. The fastening screws 82 define a triangle so that a defined attachment of the actual chill mold on the frame 52 is provided. Advantageously, the actual chill mold is supported in a vibration-dampened way on the frame 52 by means of the screws 82, i.e., by interposition of further vibration-dampening elements.

As shown in FIGS. 22 and 23 the holder 53 has actuating arms 74 for actuation of the flaps 73. The actuation arms 74 are pivotably supported on the U-shaped receptacles 89 so as to pivot about the axis of rotation 75. In the area of the axis of rotation 75 a shaft 90 is arranged that is engaged by a lever arm 83 of the actuating arm 74. The actuator 55 engages the lever arm 83. For opening the flaps 73 the actuator 55 actuates the lever arms 83 in actuation direction 79. In this way, on each actuator arm 74 two grippers 81 that engage opposite sides of a flap 73 are pulled outwardly. The grippers 81 engage bolts 80 of the flaps 73. The flaps 73 are pulled outwardly until the bolts 80 of the flaps 73 are seated in receptacles 78 of the holder 53. A further actuation of the lever arms 83 in the actuation direction 79 effects pivoting of the flaps 73 about the bolts 77 upwardly and outwardly. In this way, by means of only one actuator 55 the flap 73 can perform a combined translatory and rotary movement.

The actuator arms 74 have a transverse stay 76 on which at least one clamping element 56 is arranged. For compensating tolerances between the container 2 and the mold 51 several clamping elements 56 are arranged advantageously on each actuator arm 74. The clamping elements 56 move upon actuation of the lever arms 83 in such a way that the movement of the clamping elements 56 is coupled to the movement of the lever arms 83 and, by means of actuator arms 74, to the movement of the flaps 73. In order to press the container 2 tightly against the mold 51 or the core in the mold 51 the clamping elements 56 each have at least one actuator 91 that acts on a movable section 92 of the clamping elements 56. The movable sections 92 force the container 2 against the mold 51.

Figure 24:
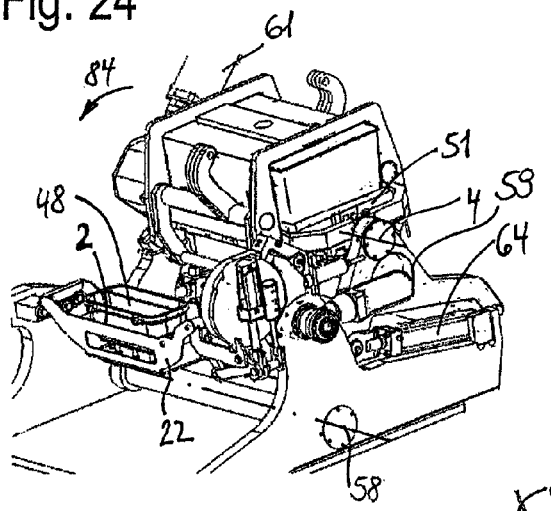
FIG. 24 the casting plant of FIG. 20 after rotation of the mold.

After insertion of the core or cores into the mold 51 (FIG. 21), the flaps 73 are closed by actuation of levers 83 in the actuation direction 79. Subsequently, the mold 51 is rotated about 180° about the axis of rotation 4 until the position illustrated in FIG. 24 is reached. The fill opening 54 of the mold 51 faces downwardly. The arm 22 is rotated about the axis of rotation 23 (FIG. 21) in such a way that the fill opening 48 of the container 2 faces upwardly in the vertical direction. Subsequently, the mold 51 is moved in the direction of arrow 84 into a position above the container 2; the container 2 remains stationary when doing so. The movement of the mold 51 into a position above the container 2 is realized by pivoting the arms 59 about axis of rotation 58. For this purpose a drive cylinder 64 is actuated. The actuators 55 are not shown in FIGS. 24 to 29.

Figure 25:
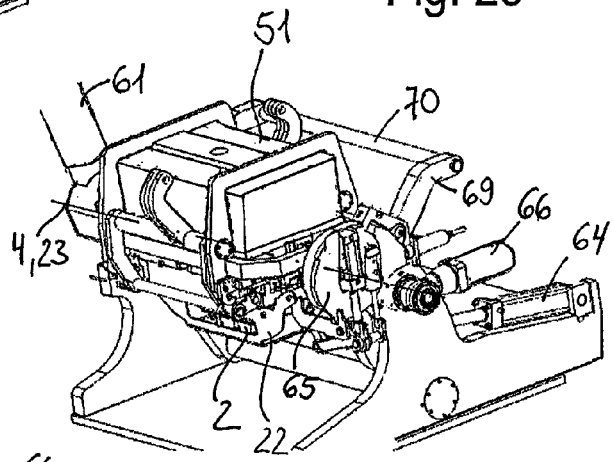
FIG. 25 the casting plant of FIG. 20 after movement of the mold into a position above the container.
Figure 26:
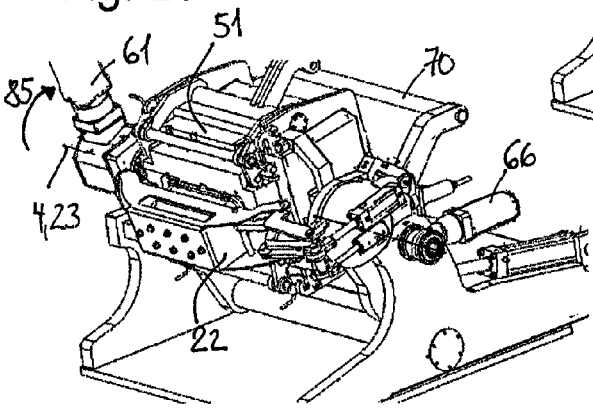
FIG. 26 the casting plant of FIG. 20 during common rotation of the mold and the container.
Figure 27:
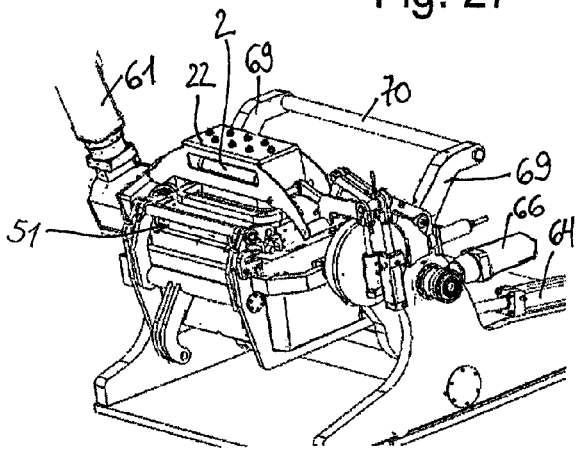
FIG. 27 the casting plant of FIG. 20 after rotation.

In FIG. 25 the arrangement of the mold 51 into a position above the container 2 is illustrated. As shown in FIGS. 25 to 27, each arm 59 has a cantilever 69. The two cantilevers 69 are connected to one another by a connecting rod 70. Upon pivoting the mold 51 from the position shown in FIG. 24 into the position shown in FIG. 25, the connecting rod 70 pivots upwardly. By means of the connecting rod 70 supply hoses for actuating cylinders on the mold 51, for example, for slides or the like, can be guided. The connecting rod 70 ensures that the supply lines are not guided across the floor. In this way it is ensured that the supply lines will not come into contact with hot melt even when melt will spill accidentally onto the floor.

After the mold 51 has been pivoted into the position above the container 2, the container 2 is pressed by means of the clamping elements 56 strongly and tightly against the mold 51. As a result of the loose attachment of the container 2 on the arm 22 the arm 22 can be arranged on the container 2. The container 2 can be moved relative to the arm 22 for compensating tolerances. After seal-tightly connecting the container 2 and the mold 51, the mold 51 and the container 2 are rotated together about the axis of rotation 4. After pivoting the mold 51 into the position above the container 2, the axis of rotation 4 is coaxial to the axis of rotation 23 of the container 2. In this way, the container 2 and the mold 51 can be rotated together. The drives 61 and 66 operate synchronously. The mold 51 and the container 2 are rotated in the direction of arrow 85 shown in FIG. 26 past the position shown in FIG. 26 about 180° until the container 2 is positioned above the mold 51 in the position illustrated in FIG. 27. As a result of the rotation of the mold 51 and the container 2, the melt has flown from the container 2 into the mold 51.

Figure 28:
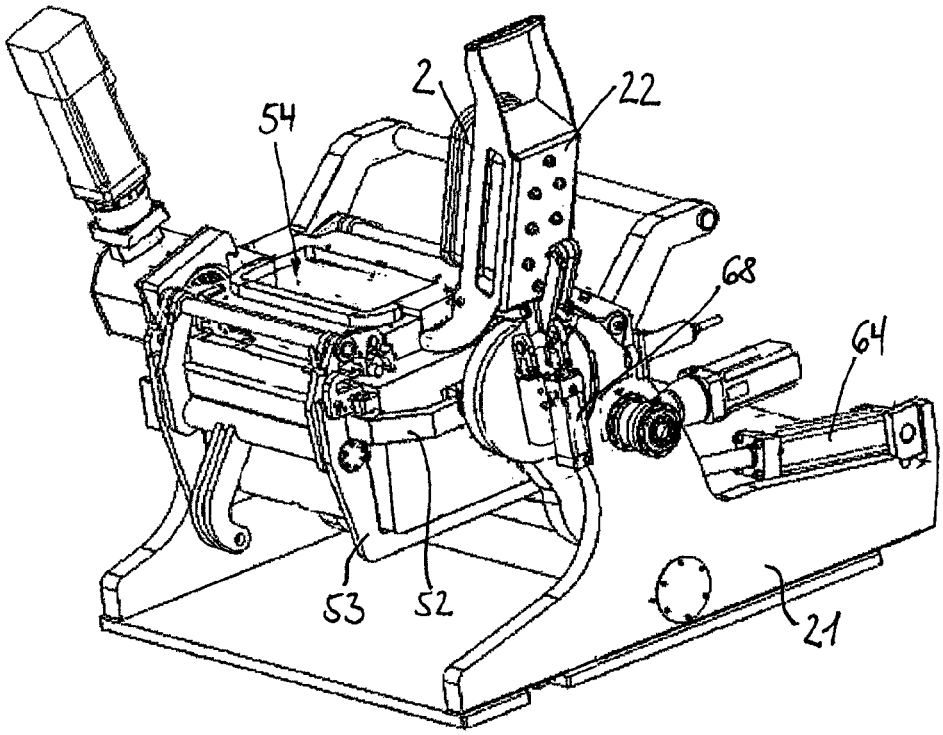
FIG. 28 the casting plant of FIG. 20 after the container has been pivoted away.
Figure 29:
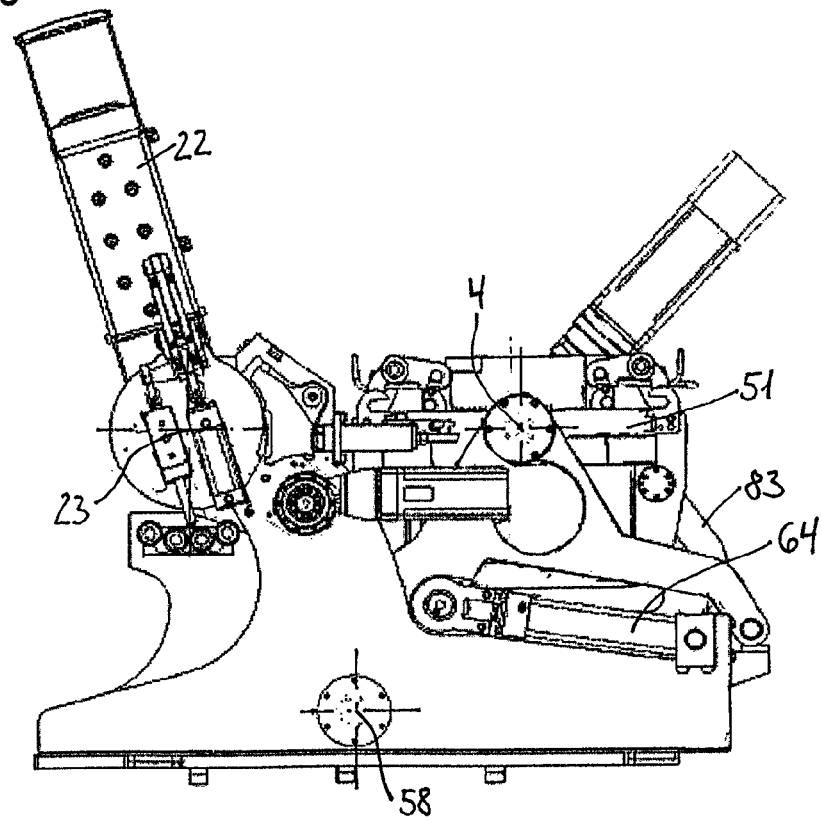
FIG. 29 the casting plant of FIG. 20 with the mold in the removal position.

Subsequently, the container is pivoted outwardly away from the fill opening 54. This is illustrated in FIG. 28. Subsequently, the mold 51 is returned by rotation about axis of rotation 58. In this rearward position the cast part can be removed. However, it can also be provided that the cast part is removed in the forward position of the mold 51, i.e., immediately after removal of the container 2 from the fill opening 54. After removal of the cast part the mold 51 and the container 2 are cleaned again. For this purpose, the mold 51 is moved into the position illustrated in FIG. 20. Afterwards, the next cast part can be manufactured.

What is claimed is:

1. A casting method for producing a cast part, the method comprising the steps of:

filling a melt to be cast into a container;

moving the mold into a position above the container after the melt to be cast has been filled into the container;

connecting seal-tightly the mold to the container;

rotating the mold and the container together so that the melt flows from the container into the mold;

separating the mold and the container from each other;

removing the cast part from the mold.

2. The casting method according to claim 1, wherein the container is not moved or moved only minimally when the mold is moved into the position above container.

3. The casting method according to claim 1, wherein, in the step of rotating, the mold and the container are rotated together by at least 180° and wherein the mold and the container are rotated together about a horizontal axis of rotation.

4. The casting method according to claim 1, further comprising the step of inserting at least one core into the mold before seal-tightly connecting the mold to the container.

5. The casting method according to claim 4, wherein the step of inserting the at least one core is carried out while the melt to be cast is filled into the container.

6. The casting method according to claim 1, wherein the container is supported on at least one arm so as to be pivotable about an axis of rotation.

7. A casting plant comprising:

a mold that is pivotably supported about a first axis of rotation to perform a first movement that is a pivot movement in a first movement direction;

a container that has a container axis and is pivotably supported so as to rotate about the container axis;

wherein the mold is supported so as to be movable by a second movement in a second movement direction;

wherein the second movement direction is a longitudinal direction;

wherein the pivot movement of the mold is coupled to the second movement in the longitudinal direction.

8. The casting plant according to claim 7, wherein the longitudinal direction extends at a slant to the horizontal.

9. The casting plant according to claim 7, wherein the mold has a holder with a closed frame on which closed frame the mold is secured.

10. The casting plant according to claim 9, wherein the mold has a mold cavity and wherein the closed frame extends in a plane that is parallel to the first axis of rotation of the mold and intersects the mold cavity.

11. A casting plant comprising:

a mold that is pivotably supported about a first axis of rotation to perform a first movement that is a pivot movement in a first movement direction;

a container that has a container axis and is pivotably supported so as to rotate about the container axis;

wherein the mold is supported so as to be movable by a second movement in a second movement direction;

further comprising a planetary gear drivingly connected to the mold, wherein the mold is driven in rotation by the planetary gear about the first axis of rotation.

12. The casting plant according to claim 11, wherein the mold is driven by a multi-stage gear comprising the planetary gear and wherein the planetary gear is the last stage of the multi-stage gear and is acting directly on the mold.

13. A casting plant comprising:

a mold that is pivotably supported about a first axis of rotation to perform a first movement that is a pivot movement in a first movement direction;

a container that has a container axis and is pivotably supported so as to rotate about the container axis;

wherein the mold is supported so as to be movable by a second movement in a second movement direction;

wherein the container axis of the container and the first axis of rotation of the mold extend horizontally.

14. The casting plant according to claim 13, wherein the second movement is a pivot movement about a second axis of rotation.

15. A casting plant comprising:

a mold that is pivotably supported about a first axis of rotation to perform a first movement that is a pivot movement in a first movement direction;

a container that has a container axis and is pivotably supported so as to rotate about the container axis;

wherein the mold is supported so as to be movable by a second movement in a second movement direction;

wherein at least one of the mold and the container has means that compensate tolerances between a sealing surface of the mold and a sealing surface of the container, wherein the sealing surfaces rest against one another when the mold and the container are connected to one another and rotated together.

16. A casting plant comprising:

a mold that is pivotably supported about a first axis of rotation to perform a first movement that is a pivot movement in a first movement direction;

a container that has a container axis and is pivotably supported so as to rotate about the container axis;

wherein the mold is supported so as to be movable by a second movement in a second movement direction;

wherein the mold has a fill opening on which the container is securable by at least one clamping element.

17. The casting plant according to claim 16, further comprising at least one actuator for the at least one clamping element that is arranged on a bottom side of the mold, which bottom side is facing away from the fill opening.

18. The casting plant according to claim 16, wherein the mold has at least one movably supported cover element and wherein a movement of the at least one clamping element is coupled to a movement of the at least one cover element.

* * * * *